US010426993B2

(12) United States Patent
Ostmeyer et al.

(10) Patent No.: US 10,426,993 B2
(45) Date of Patent: Oct. 1, 2019

(54) TRACK-MOUNTED LEVER RELEASE EXERCISE RACK ACCESSORY MOUNT

(71) Applicant: USA Strength and Performance, LLC, Greenback, TN (US)

(72) Inventors: Matthew Ostmeyer, Maryville, TN (US); Jason Murrell, Knoxville, TN (US); Bryan Schmidt, Greenback, TN (US); Steve Schmidt, Greenback, TN (US)

(73) Assignee: Arsenal Strength LLC, Knoxville, TN (US)

( * ) Notice: Subject to any disclaimer, the term of this patent is extended or adjusted under 35 U.S.C. 154(b) by 153 days.

(21) Appl. No.: 15/615,919

(22) Filed: Jun. 7, 2017

(65) Prior Publication Data

US 2018/0353795 A1 Dec. 13, 2018

(51) Int. Cl.

| | |
|---|---|
| ***A63B 21/078*** | (2006.01) |
| ***A63B 21/062*** | (2006.01) |
| ***A63B 21/00*** | (2006.01) |
| ***A63B 23/035*** | (2006.01) |

(52) U.S. Cl.

CPC ..... *A63B 21/0783* (2015.10); *A63B 21/0626* (2015.10); *A63B 21/4045* (2015.10); *A63B 23/035* (2013.01); *A63B 21/078* (2013.01)

(58) Field of Classification Search

CPC ..... A63B 21/078; A63B 21/0783; A63B 21/0626; A63B 23/035; A63B 21/4045; Y10T 403/7073; Y10T 403/59; Y10T 403/591; Y10T 403/592; F16B 21/09; F16B 2200/30; F16B 2200/50

See application file for complete search history.

(56) References Cited

U.S. PATENT DOCUMENTS

| | | | | |
|---|---|---|---|---|
| 1,422,128 | A | 7/1922 | Rager | |
| 4,286,782 | A | 9/1981 | Fuhrhop | |
| 4,492,375 | A | 1/1985 | Connelly | |
| D416,471 | S * | 11/1999 | Wurdack | D8/363 |
| 6,422,523 | B1 | 7/2002 | Weshler | |

(Continued)

OTHER PUBLICATIONS

Tuffstuff Fitness International product catalog.
TuffStuff Fitness International Inc. Pro-Xl Sports Performance Rack Video Brochure screen shot.

*Primary Examiner* — Megan Anderson
(74) *Attorney, Agent, or Firm* — Chambliss, Bahner & Stophel, P.C.

(57) ABSTRACT

An exercise apparatus includes two or more vertical rack members. Tracks on the rack members include an elongate carrier guide extending substantially along the length of the track and a notched retention bar. An accessory carrier, having an accessory removably mounted thereon, slides vertically along the carrier guide. A carrier lock is mounted to the accessory carrier at a pivot point and has a handle located on one side of the pivot point and a locking tip on the opposite side of the pivot point for selectively engaging a notch of the retention bar for securing the accessory carrier at a selected position. The carrier lock rotates between locked and unlocked positions. When locked, the locking tip is located within a notch and prevents the accessory carrier from sliding along the carrier guide. In the unlocked position, the accessory carrier can freely slide along the carrier guide.

13 Claims, 13 Drawing Sheets

(56) References Cited

U.S. PATENT DOCUMENTS

| | | | | |
|---|---|---|---|---|
| 7,337,730 | B2 | 3/2008 | Bienick et al. | |
| 7,338,416 | B2 | 3/2008 | Smith | |
| 7,374,516 | B2 | 5/2008 | Lundquist | |
| 8,337,370 | B2 | 12/2012 | Rogers et al. | |
| 9,044,643 | B2 * | 6/2015 | Staten | A63B 21/0783 |
| 9,101,198 | B2 * | 8/2015 | Tseng | F41C 33/041 |
| 10,058,728 | B2 * | 8/2018 | Kelly | F16M 13/022 |
| 2007/0155595 | A1 | 7/2007 | Rogers et al. | |
| 2009/0072111 | A1 | 3/2009 | Paine, Jr. | |
| 2012/0289384 | A1 | 11/2012 | Staten et al. | |
| 2014/0200117 | A1 | 7/2014 | Grider | |
| 2015/0083681 | A1 | 3/2015 | Childs | |
| 2018/0200563 | A1 * | 7/2018 | Hansen | F16B 2/10 |

* cited by examiner

TRACK-MOUNTED LEVER RELEASE EXERCISE RACK ACCESSORY MOUNT

FIELD OF THE INVENTION

This invention relates to the field of exercise racks. More particularly, this invention relates to carriers for mounting accessories to an exercise rack and for positioning the accessories at selected heights on the exercise rack.

BACKGROUND

In the description that follows, the term "exercise rack" is used broadly to include any sort of structure intended to support exercise weights, including squat racks, press racks, and the like. Certain exercise racks include left and right vertical members with pairs of mounting locations provided along the length of the vertical members for mounting accessories to the vertical members. For example, bar catch accessories for supporting an exercise bar, such as a barbell, provided with or without weights, may be placed onto the exercise rack. The and left and right bar catches are mounted to the vertical members and may be moved to various mounting locations to support the barbell at various heights. The height of the bar may need to be adjusted based on the type of exercise being performed. For example, the exercise bar may be placed at a low position in the rack with respect to the floor surface and used for bench press exercises. At other times, the exercise bar may be placed at a higher position in the rack with respect to the floor surface and used for squats or overhead press exercises. In addition to transitioning from one type of exercise to another, another reason that the bar might be moved from a first vertical position to a second vertical position on the rack is to accommodate multiple users of the rack that are of varying heights. Other accessories, such as safety bars, may also be mounted to the vertical members of the exercise rack. These bars are often used to support a loaded barbell during rest periods, such as between sets, and also to catch the bar in an accidental drop.

One problem with mounting accessories to an exercise rack using the methods described above is that vertically adjusting the accessory is time consuming. Vertically adjusting the accessory often requires that the accessory be disconnected from the vertical members, re-positioned, and then reconnected to the vertical members. This can be a difficult and dangerous process, which could result in the accessory being dropped and or damaged in the process. Another problem is that only the bar catches and safety bars can be mounted to the vertical members of the exercise rack, and other accessories cannot typically be mounted to the rack. Thus, the vertical members provided limited utility.

Accordingly, what is needed is an exercise rack and accessory mount that provides for faster and safer vertical adjustment of an accessory on the rack and that allows for greater flexibility in the types of accessories that can be mounted to the rack.

SUMMARY OF THE CLAIMS

The above and other problems are addressed by a quick disconnect exercise rack accessory apparatus as described below. The apparatus includes an accessory for an exercise rack having a use portion and a mounting plate fixedly mounted to an end of the use portion. An accessory carrier has a first side configured to mount to an exercise rack and a second side configured to connect to the accessory. A slot is formed in the second side of the accessory carrier having an open end, an inner section, and an outer section that is in communication with the inner section. The accessory is removably mounted to the accessory carrier by sliding the mounting plate into the slot via the open end such that the mounting plate is located within the inner section of the slot and the accessory extends through the outer section of the slot.

In certain embodiments, the mounting plate includes a lip portion that extends outwards beyond an exterior surface of the use portion. The slot of the accessory carrier also includes a lip portion disposed along an inner surface of the outer section that is configured to engage the lip portion of the mounting plate to prevent the mounting plate from being removed via the outer section of the slot. As such, the accessory may only be removed by sliding the accessory and the mounting plate out of the carrier via the open end in the slot.

Certain embodiments include a safety stop, located on the accessory carrier near the slot, which is configured to move between a second (i.e., unlocked) position and a first (i.e., locked) position. When the safety stop is in the second (i.e., unlocked) position and the mounting plate is located within the slot, the mounting plate may slide out of the slot freely. However, when the safety stop is in the first (i.e., locked) position and the mounting plate is located within the slot, the safety stop engages the mounting plate and prevents the mounting plate from sliding out of the slot. The safety stop may be provided with a biasing member for biasing the safety stop to the first (i.e., locked) position. In certain cases, the safety stop is configured to be contacted by and moved automatically to the second (i.e., unlocked) position by the mounting plate as the mounting plate slides into the slot. In those cases, the biasing member automatically returns the safety stop to the first (i.e., locked) position after the mounting plate has been inserted into the slot sufficiently far in order to secure the mounting plate within the slot.

In certain embodiments, the safety stop is rotatably mounted to the accessory carrier via a pivot point. The safety stop includes a user contact portion disposed on one side of the pivot point. The user contact portion is configured to be contacted by a user to rotate the safety stop about the pivot point to move the safety stop from the first (i.e., locked) position to the second (i.e., unlocked) position. A locking tip is located on the opposite side of the pivot point, and it is configured to engage a portion of the mounting plate in the first (i.e., locked) position. In some cases, a notch is formed proximate a top surface of the mounting plate, and the locking tip of the safety stop engages the notch in the first (i.e., locked) position. In some cases, a left notch is located on a left side of the top surface of the mounting plate and a right notch is located on a right side of the top surface of the mounting plate. As such, the safety stop may engage either the left side or right side of the mounting plate.

In some embodiments, the apparatus includes a first accessory carrier and a second accessory carrier. A first mounting plate is located at a first end of the accessory and a second mounting plate is located at a second end of the accessory. In that case, either of the first and second mounting plates may be removably mounted to either of the first and second accessory carriers.

In a second major embodiment, an exercise rack apparatus is provided. The apparatus includes two or more vertical rack members and a track disposed on at least two of the two or more vertical rack members. Each track has an elongate carrier guide extending substantially along the length of the track and a retention bar, provided with plurality of notches formed therein, that connects the carrier guide to the vertical rack member. An accessory carrier is configured to engage and to slide vertically along the carrier guide of the track. A carrier lock is pivotally mounted to the accessory carrier at a pivot point. The carrier lock includes a handle located on one side of the pivot point for rotating the carrier lock about the pivot point. The carrier lock further includes a locking tip on an opposite side of the pivot point for selectively engaging a notch of the retention bar for securing the accessory carrier at a selected vertical position on the track. The carrier lock rotates between a first position, where the locking tip is located within a notch and contacts a portion of the retention bar to prevent the accessory carrier from sliding vertically along the carrier guide, and a second position, where the locking tip is not located within a notch and the accessory carrier can freely slide along the carrier guide. Lastly, an accessory is mounted to the accessory carrier.

In certain embodiments, the apparatus includes a first upwardly-extending tooth located on the locking tip of the carrier lock and a second downwardly-extending tooth located within each of the notches of the track. The first tooth engages with the second tooth when the carrier lock is in the first position and the accessory carrier is raised vertically. The carrier lock is prevented from rotating to the second position due to the engagement between the first and second teeth.

In some cases, the apparatus includes first and second rotation limiting members located below and above the carrier lock for limiting the rotation of the carrier lock. When the carrier lock is in first position, its rotation is limited by the first rotation limiting member. When the carrier lock is in second position, its rotation is limited by the second rotation limiting member. In some cases, rotation of the carrier lock is also limited by the first rotation limiting member in the second position.

In certain embodiments, each notch on the track has contoured section that is sloped away from the carrier lock. The contoured section is designed so that the bottom end of the contoured section is furthest from the carrier lock and the top end of the contoured section is nearest the carrier lock. The contoured section is configured to contact a portion of the carrier lock and to assist in guiding it into the first (i.e., locked) position.

In a final major embodiment, an exercise rack and accessory apparatus is provided. The apparatus includes two or more vertical rack members, a track disposed on at least two of the two or more vertical rack members. Each track includes an elongate carrier guide extending substantially along the length of the track and a retention bar, including a plurality of notches formed therein, connecting the carrier guide to the vertical rack member. The apparatus further includes an accessory carrier having a first side that engages and slides vertically along the carrier guide of the track. The accessory carrier also has a second side that removably mounts to an end of the accessory. A carrier lock is pivotally mounted to the accessory carrier at a pivot point. The carrier lock includes a handle located on one side of the pivot point for rotating the carrier lock about the pivot point. A locking tip is located an opposite side of the pivot point for selectively engaging a notch of the retention bar for securing the accessory carrier at a selected vertical position. The carrier lock is configured to rotate between a first (i.e., locked) position, where the locking tip is located within a notch and contacts a portion of the retention bar to prevent the accessory carrier from sliding vertically along the carrier guide, and a second (i.e., unlocked) position, where the locking tip is not located within a notch and the accessory carrier can freely slide along the carrier guide. Lastly, an accessory is mounted to the accessory carrier.

In some embodiments, a slot is formed in the second side of the accessory carrier. The slot has an open end, an inner section, and an outer section that is in communication with the inner section. The accessory is removably mounted to the accessory carrier by sliding its mounting plate into the slot via the open end such that the mounting plate is located within the inner section of the slot and the accessory extends through the outer section of the slot. In certain cases, a safety stop is located on the accessory carrier near the inner section of the slot. The safety stop is configured to move between a first (i.e., locked) position and a first (i.e., unlocked) position. When the safety stop is in the second (i.e., unlocked) position and the mounting plate is located within the slot, the mounting plate may slide out of the slot freely. However, when the safety stop is in the first (i.e., locked) position and the mounting plate is located within the slot, the safety stop engages the mounting plate and prevents the mounting plate from sliding out of the slot. In some cases, the safety stop is configured to be contacted by and moved automatically to the second (i.e., unlocked) position by the mounting plate as the mounting plate slides into the slot. The biasing member automatically returns the safety stop to the first (i.e., locked) position after the mounting plate has been inserted into the slot sufficiently far in order to secure the mounting plate within the slot. In some cases, a notch is formed in a top surface of the mounting plate. The contact portion of the safety stop engages the notch in the first (i.e., locked) position.

In certain cases, a first upwardly-extending tooth is located on the locking tip of the carrier lock. Additionally, a second downwardly-extending tooth is located within each of the notches of the track. The first tooth engages with the second tooth when the carrier lock is in the first (i.e., locked) position and the accessory carrier is raised vertically, such that the carrier lock is prevented from rotating to the second (i.e., unlocked) position due to the engagement between the first and second teeth.

Lastly, in certain cases, the apparatus includes first and second rotation limiting members located below and above the carrier lock. The rotation limiting members limit the degree of rotation of the carrier lock. When the carrier lock is in the first (i.e., locked) position, its rotation is limited by the first rotation limiting member. When the carrier lock is in second (i.e., unlocked) position, its rotation is limited by the second rotation limiting member. In some cases, rotation of the carrier lock is also limited by the first rotation limiting member in the second position.

BRIEF DESCRIPTION OF THE DRAWINGS

Further advantages of the invention are apparent by reference to the detailed description when considered in conjunction with the figures, which are not to scale so as to more clearly show the details, wherein like reference numbers indicate like elements throughout the several views, and wherein.

DETAILED DESCRIPTION

Figure 1:
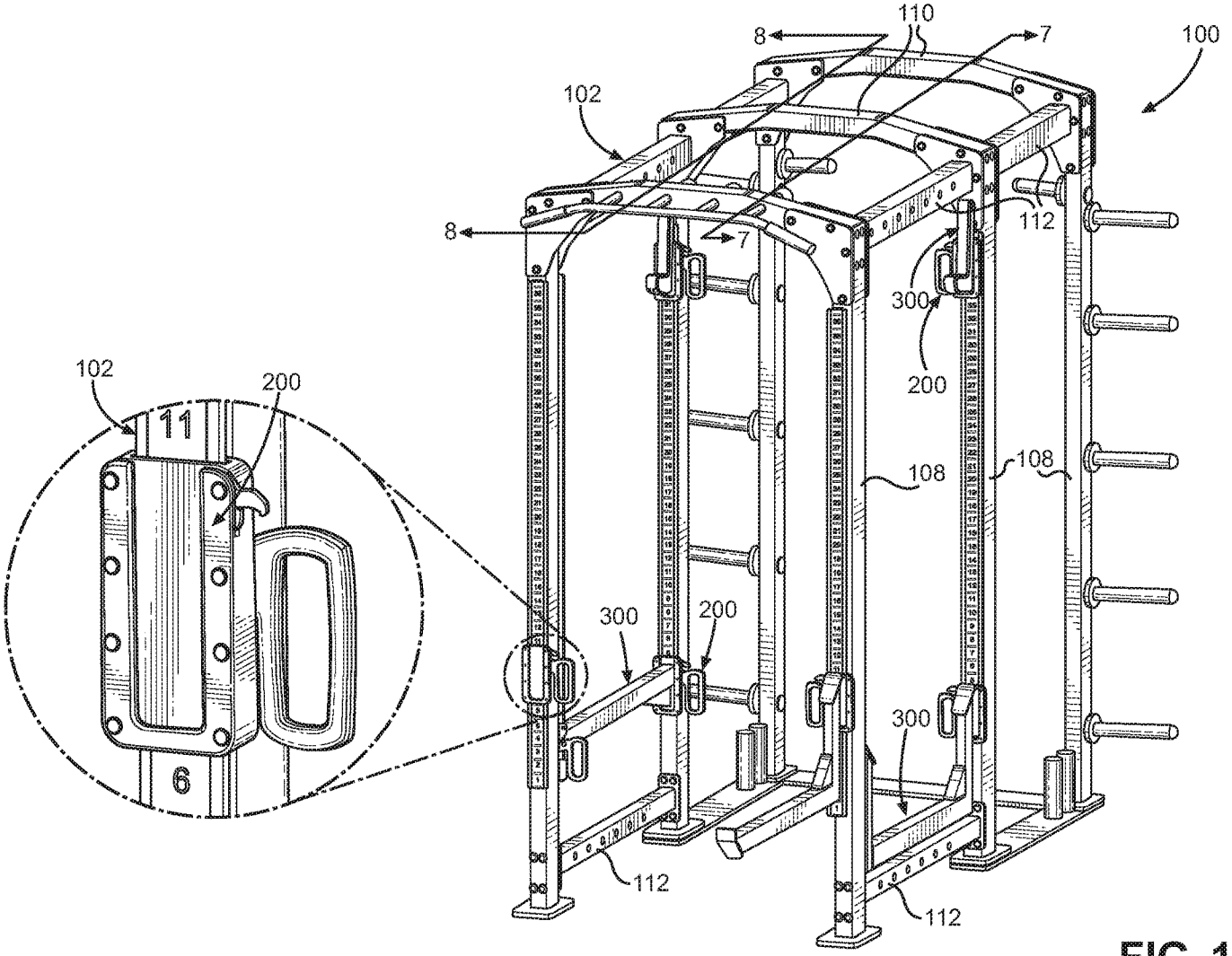
FIG. 1 is a perspective view depicting an exercise rack according to an embodiment of the present disclosure.

Referring now to the drawings in which like reference characters designate like or corresponding characters throughout the several views, there is shown in FIG. 1, an exercise rack and accessory apparatus 100 according to an embodiment of the present disclosure. The apparatus 100 includes generally an exercise rack 102, at least one accessory 300 for an exercise rack, and an accessory carrier 200 mounted to the exercise rack and also mounted to the accessory. The accessory carrier 200 enables accessories 300 to be quickly mounted to and removed from the exercise rack 102.

As it is used in this description, the term "accessory" is used broadly to refer to a device that is mounted to a portion of an exercise rack, including particularly those devices mounted to or between vertical members of the exercise rack, such as J-hooks (i.e., bar catches), safety catches, pull-up bars, and the like.

Figure 3:
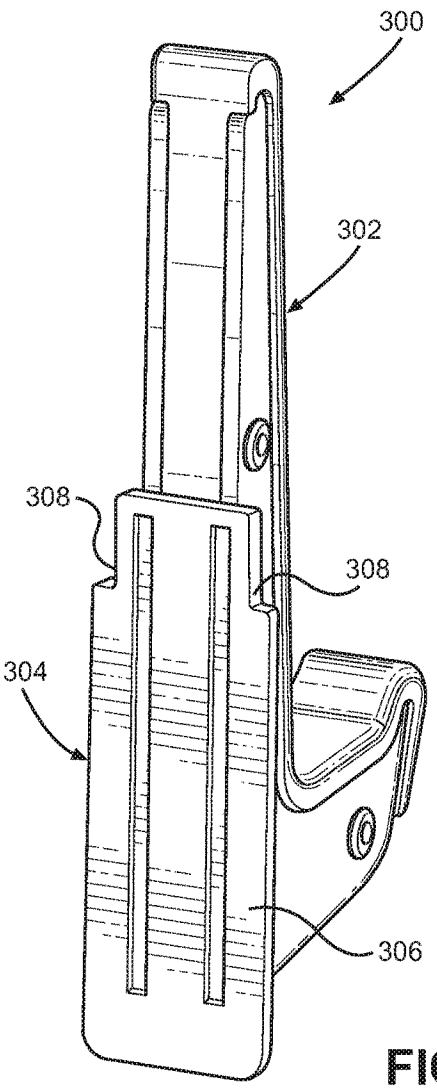
FIGS. 2 and 3 are front and rear perspective views, respectively, of an exercise rack accessory according to an embodiment of the present disclosure.
Figure 2:
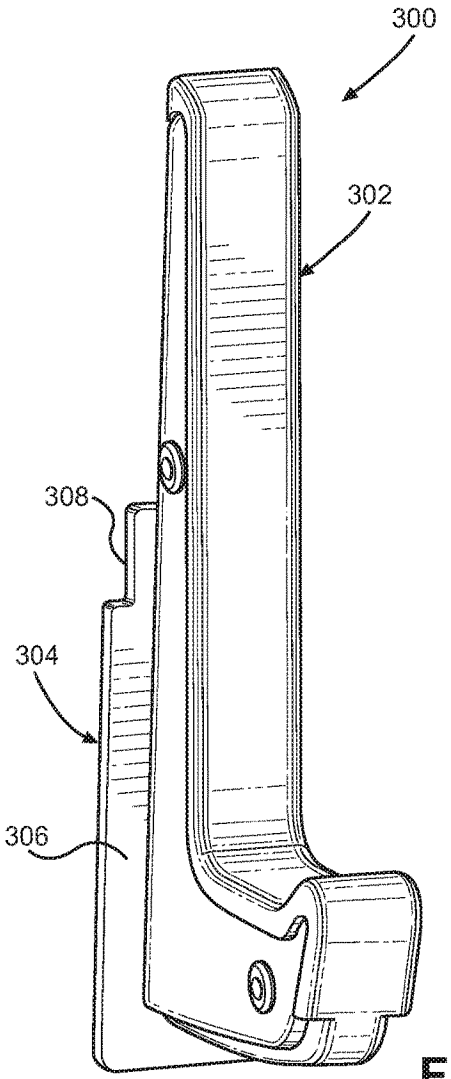

As shown in FIGS. 2 and 3, each of the accessories 300 includes use portion 302 of the accessory. Typically, the use portion 302 is where the user or weights contact the accessory. For example, in the case of a safety bar accessory, a barbell may be placed directly onto the use portion 302. In the case of a pullup accessory, the user may grasp the use portion to perform the exercise. Each accessory has at least one mounting plate 304 that is fixedly mounted to the use portion 302. The mounting plate 304 includes a lip portion 306 that extends outwards away from the use portion 302. In this particular case, the lip portion 306 extends outwards from the left and right sides and the bottom of the use portion 302. As discussed further below, the lip portion 306 of the accessory 300 is configured to slide into a slot formed in the accessory carrier 200 to removably mount the accessory within the accessory carrier. In certain cases, the mounting plate 304 may be provided with one or more notches 308 formed in a top surface of the lip portion 306. As discussed further below, the notches 308 interact a locking mechanism, which prevents the accessory 300 from being lifted out of the accessory carrier 200 accidentally.

Figure 4:
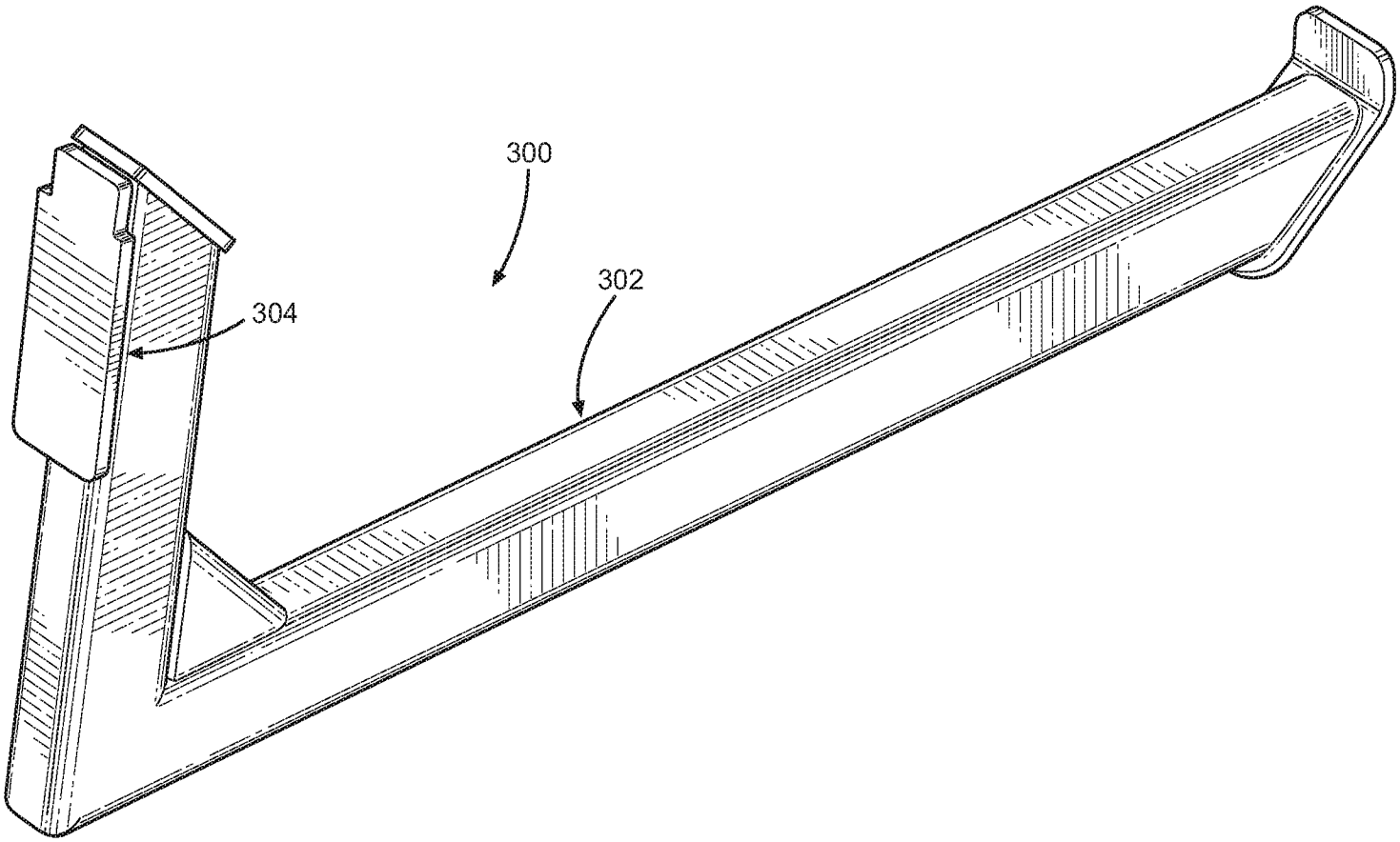
FIGS. 4-6 depict alternative exercise rack accessories according to various embodiments of the present disclosure.

The accessories shown in FIGS. 2 and 3 are often referred to as J-hooks or bar catches. They are typically mounted to a front face of left and right sides of an exercise rack and support a portion of an exercise bar (e.g., barbell). Other types of accessories may be mounted to the exercise rack 102 using the presently-described apparatus. For example, FIG. 4 provides a safety catch use portion 302 that may be mounted, on only one end, to a vertical member of an exercise rack via a mounting plate 304.

Figure 5:
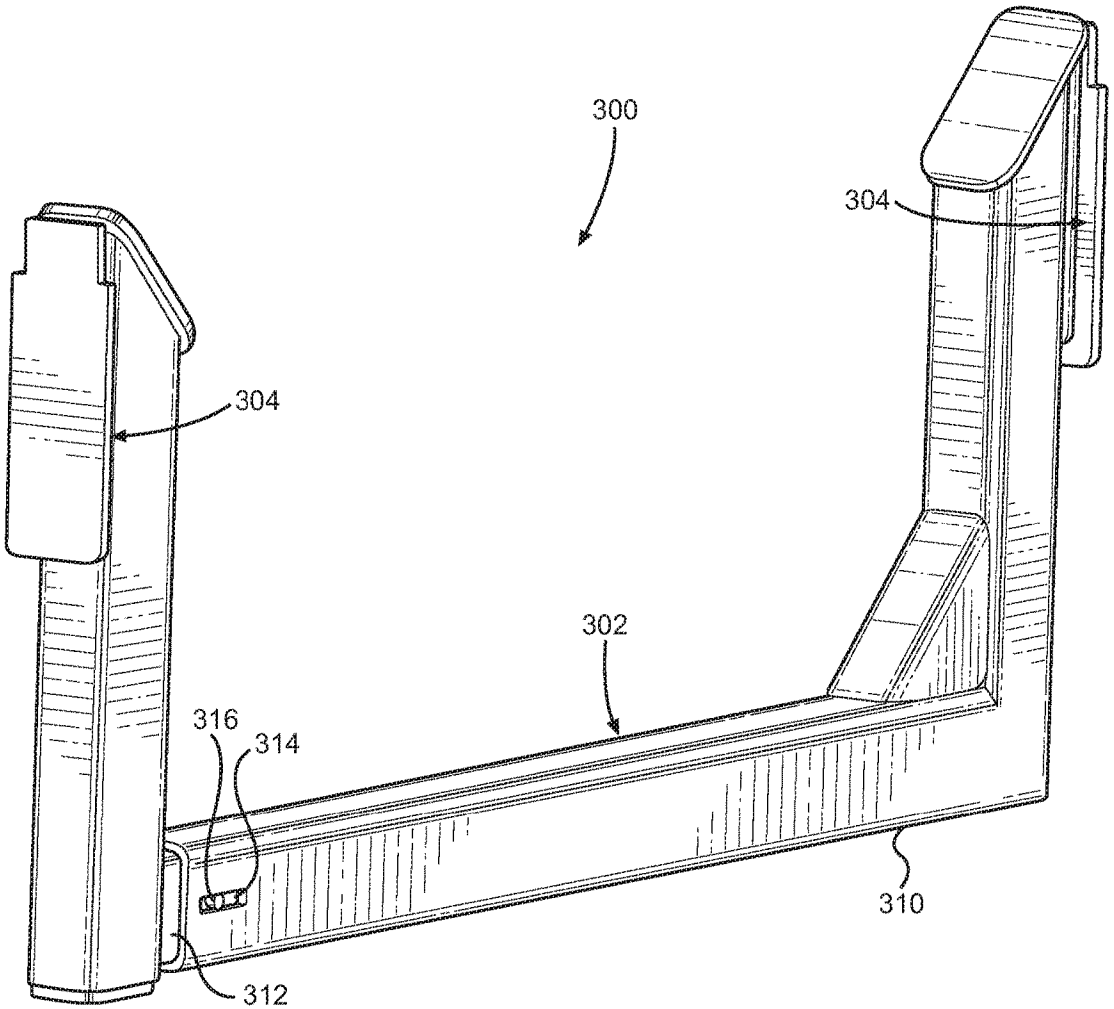
Figure 6:
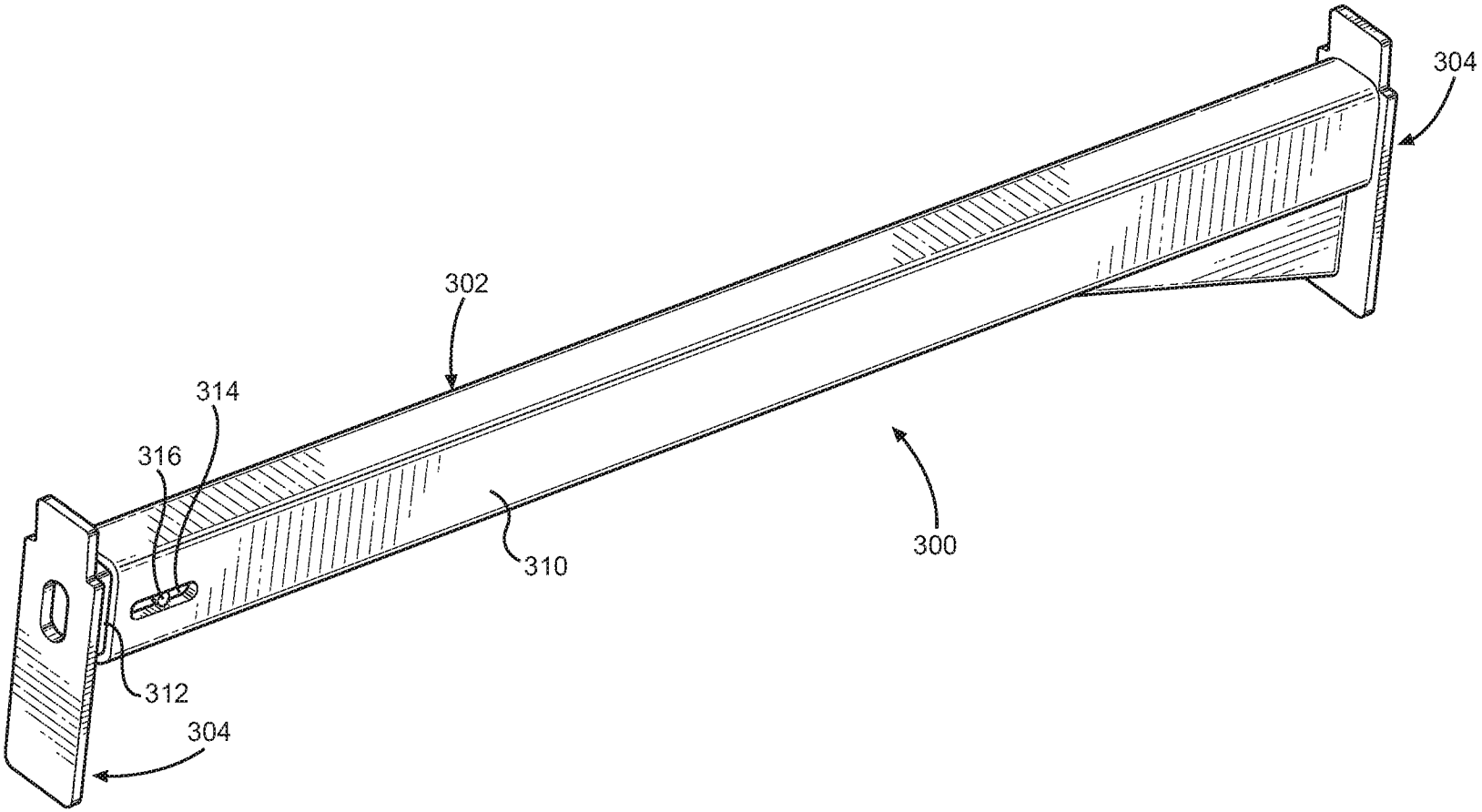

On the other hand, FIGS. 5 and 6 provide two safety catch accessories 300 that may be mounted between two vertical members of an exercise rack. These accessories 300 might be useful, for example, as safety catches to prevent an exercise bar from hitting the floor. Accordingly, these accessories 300 include mounting plates 304 located at opposing ends of the use portion 302 that support the accessory between vertical members of an exercise rack.

These accessories 300 are adjustable in length. This adjustability enables the accessories 300 to fit between vertical members that are spaced at varying distances apart. The adjustability also simplifies the installation process by allowing the accessories to be shortened while being placed between the vertical members and then extended to mount the mounting plates 304 to the exercise rack. The use portion 302 of these accessories 300 includes a first horizontal member 310 having a hollow interior and that is open on one end. A second horizontal member 312 is configured to slide into the hollow interior of the first horizontal member 310 via the open end. The size of the accessory 300 may be increased or decreased by sliding the second horizontal member 312 out of or into the first horizontal member 310. The amount of relative member between the horizontal members 310, 312 may be limited by engaging a first limiting member 314 with a second limiting member 316. In this particular case, the first limiting member 314 is an elongate slot formed into the first horizontal member 310. The second limiting member 316 is a detent extending outwards from the second horizontal member 312 that is configured to slide within the slot (i.e., first limiting member) 314.

Figure 7:
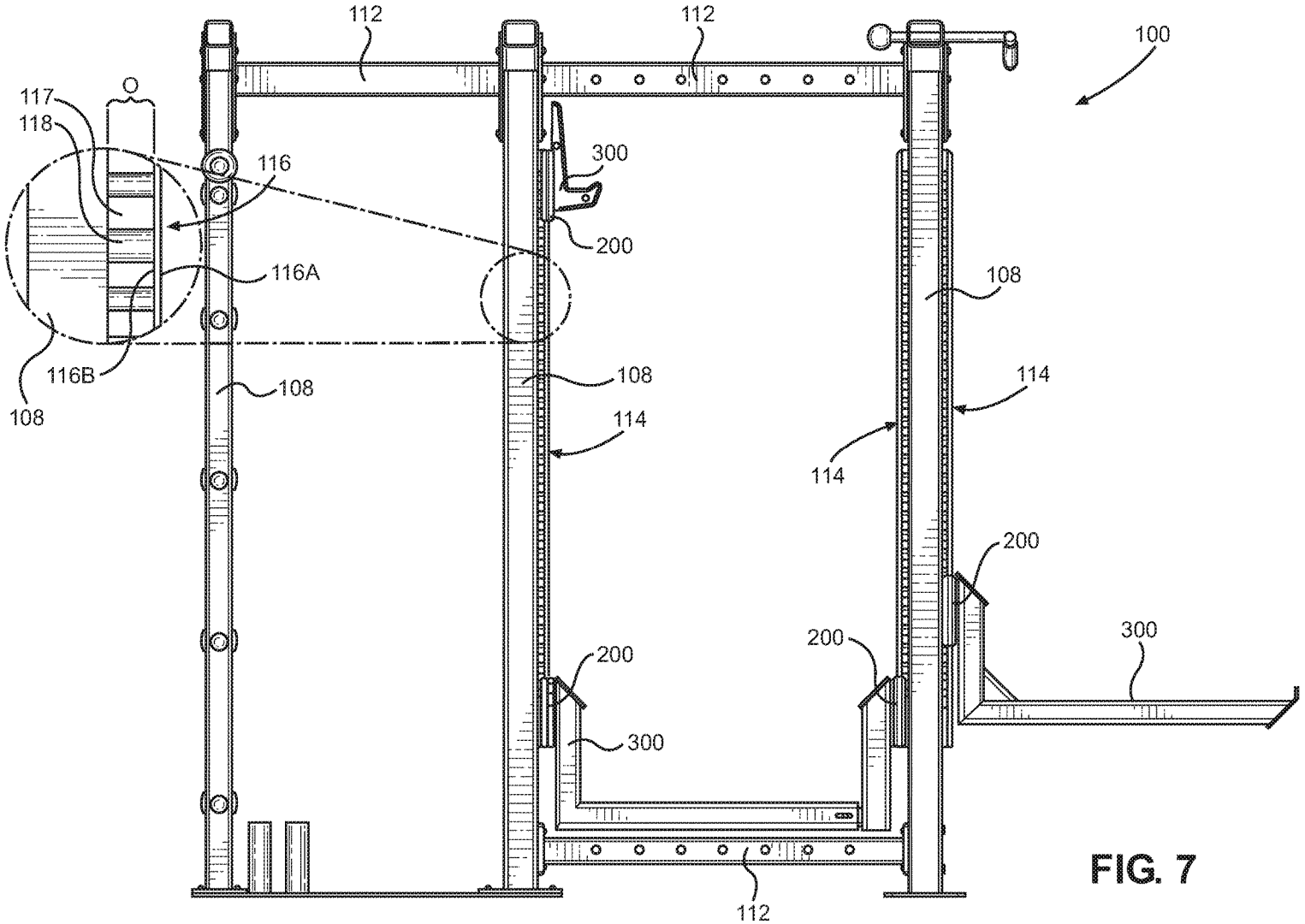
FIG. 7 is a plan view of the exercise rack of FIG. 1 shown along section line 7-7.
Figure 8:
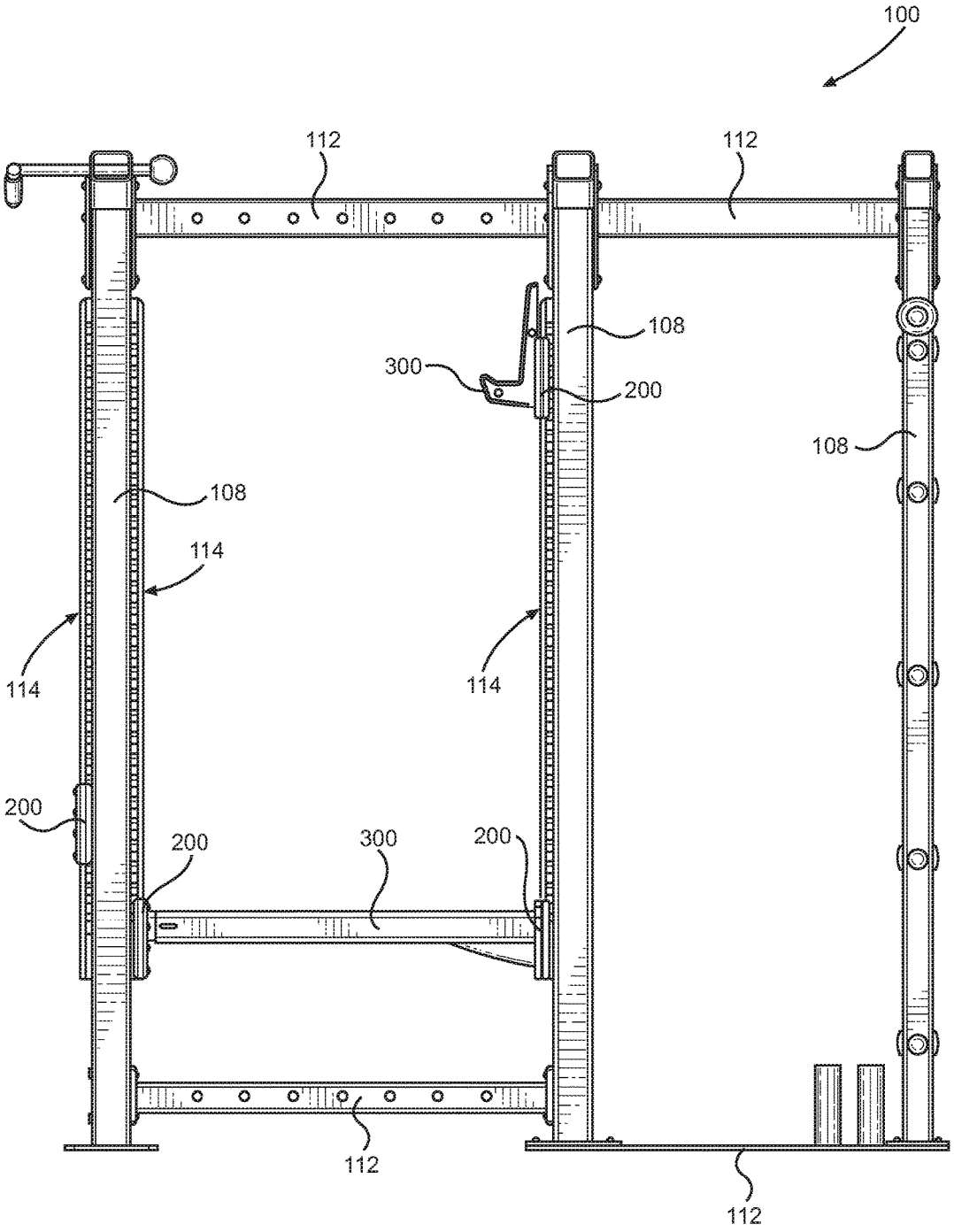
FIG. 8 is a plan view of the exercise rack of FIG. 1 shown along section line 8-8.
Figure 9:
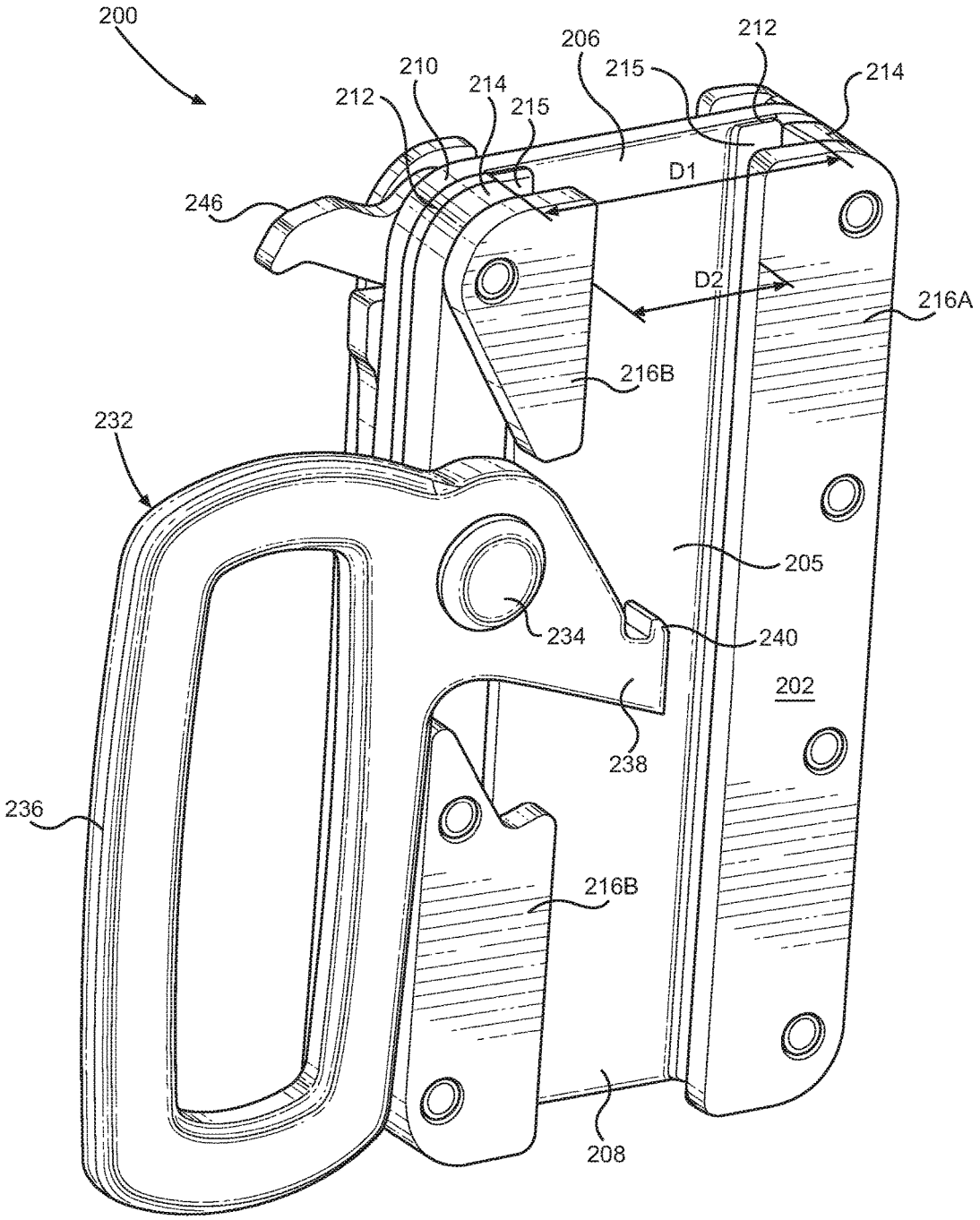
FIG. 9 is a front perspective view of an accessory carrier according to an embodiment of the present disclosure.
Figure 10:
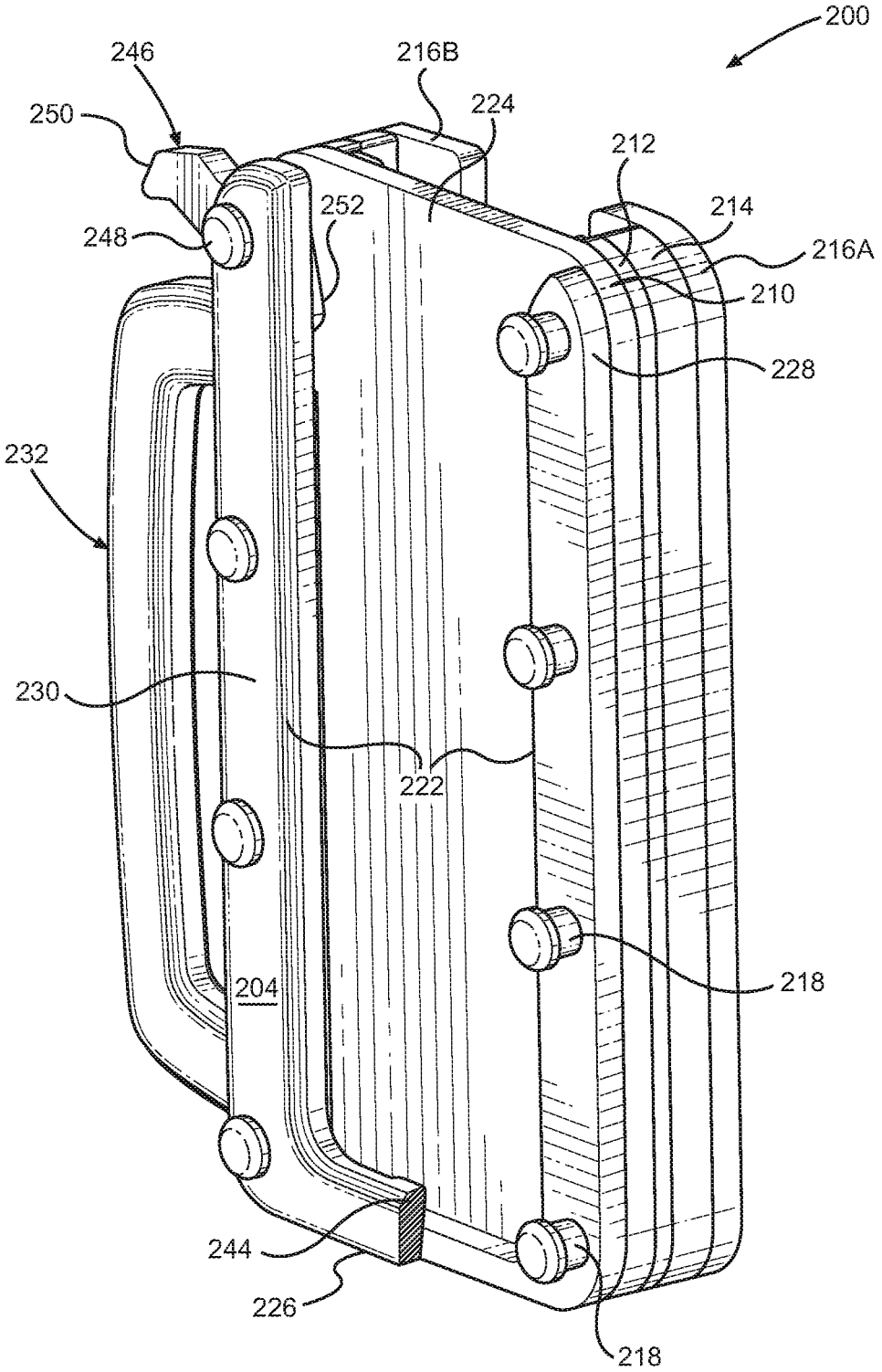
FIG. 10 is a rear perspective view of an accessory carrier according to an embodiment of the present disclosure.
Figure 11:
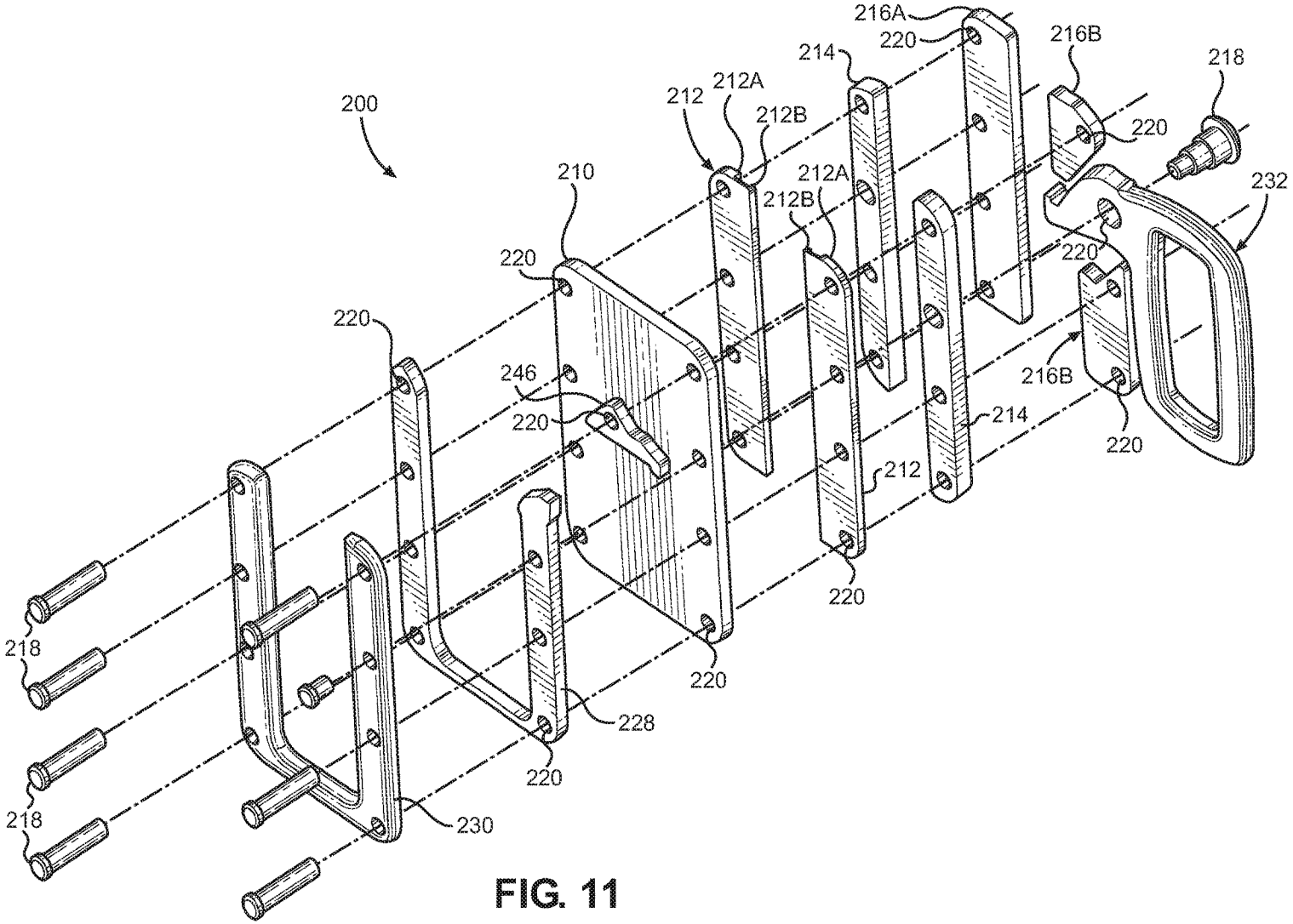
FIG. 11 is a front exploded view of the accessory carrier shown in FIG. 4.

The accessories 300 described above are shown mounted to an exercise rack 102 in FIG. 1 and FIGS. 7 and 8. At a minimum, an exercise rack 102 should include at least two vertical rack members 108 that are arranged and configured such that an exercise bar (e.g., a weighted barbell) may be placed between them and ends of the bar are supported by the accessories 300 mounted to the vertical rack members. In this particular case, a full cage is provided with a total of six vertical rack members 108, which are arranged into three sets of aligned pairs that are connected together by lateral (e.g., side-to-side) connectors 110. Top ends of the pairs of vertical rack members 108 are connected together by longitudinal (e.g., front-to-back) connectors 112. Additionally, bottom ends of the rack members 108 may also be connected by additional longitudinal connectors 112.

Tracks 114 are mounted to multiple of the vertical rack members 108. The tracks 114 are typically arranged in pairs, with one track disposed on a right side of the rack 102 and a corresponding track located on a left side of the rack. This configuration enables an elongate weight bar, such as a barbell, to be supported at opposite ends by accessories 300, such as J-hooks or safety bars, mounted to tracks 114. Generally, these tracks 114 are mounted to front and back surfaces of the vertical rack members 108. This allows opposite ends of exercise bars to be supported by the exercise rack 102 such that the accessory extends between two adjacent vertical rack members 108. However, a single track 114 (i.e., not a pair) may be mounted the exercise rack 102. Also, tracks 114 may be mounted to surfaces other than the front and back of the vertical rack members 108 (e.g., sides of the vertical members). Each track 114 includes an elongate rectangular bar-shaped carrier guide 116. The carrier guide 116 is mounted to the vertical rack members 108 and serves as an interface that connects the accessory carrier 200 to the exercise rack 102. Each track 114 also includes a retention bar 117, which includes a plurality of spaced apart notches 118 formed therein, that extends vertically and substantially along the length of the track. As discussed below, the accessory carrier 200 is fixed at a selected vertical location by engaging it with the notches 118 of the retention bar 117. An offset O is provided between the carrier guide 116 and the vertical rack member 108 by mounting the retention bar 117 between the carrier guide and the vertical member. This offset O allows the accessory carrier 200 to contact a front surface 116A and a rear surface 116B of the carrier guide in order to securely mount the accessory carrier to the track 114. Accordingly, the accessory carrier 200 serves a dual purpose of mounting an accessory to the exercise rack 102 and also vertically positioning the accessory on the exercise rack.

With reference to FIGS. 9-12, the accessory carrier 200 has a first side 202 that is mounted to the exercise rack 102 and a second side 204 that may be removably mounted to an accessory 300. The accessory carrier 200 is formed by several layers that are stacked together as a single unit. A rectangular central plate 210 divides the first side 202 from the second side 204. The central plate 210 has vertically-oriented mounting holes 220 disposed along its left and right sides. Each of the other layers discussed below also include mounting holes 220 that correspond to one or more of the mounting holes in the central plate 210. The layers are connected together by connectors 218 (e.g., threaded connectors, rivets, etc.) that pass through the mounting holes 220 and fixed therein. Once mounted together, the above-described components form a channel 205 on the first side of the accessory carrier 200. The channel 205 has an open upper end 206 and open lower end 208 that is configured to engage and to slide vertically along the carrier guide 116 of the track 114. Similarly, a slot 222 having an open upper end 224 and enclosed lower end 226 is formed on the second side 204 of the accessory carrier 200. The mounting plate 304 of the accessory 300 slides into the slot 222 and is retained there in order to removably mount the accessory to the accessory carrier 200.

On the first side 202, elongate bar-shaped first spacers 212 extend along each of the left and right sides of the central plate 210 on either side of the channel 205. The first spacers 212 are divided vertically lengthwise, having a thick outer portion 212A, including mounting holes 220, on one side of the divide and a comparatively thinner inner portion 212B on the opposite side of the divide. The first spacers 212 are spaced apart from one another and arranged so that the inner portions 212B are nearest the center of the central plate 210. The outer portions 212A are along the outer left and right edges of the central plate 210 such that the mounting holes 220 of each is aligned. A second set of elongate bar-shaped spacers 214 is mounted to the first set of spacers 212. The second spacers 214 are approximately the same size and dimensions as the outer portion 212A of the first spacers 212. First retainers 216A, 216B are mounted to the second set of spacers 214. The first retainers 216A, 216B are wider than the second spacers 214 such that a portion of the first retainers extend inwards beyond the second spacers. As a result, parallel vertical slots 215 are formed along the left and right sides of the channel 205. On one side of the channel 205, the slot 215 is defined by an elongate bar-shaped first retainer 216A, a second spacer 214, and the inner portion 212B of a first spacer 212. On the opposite side of the channel 205, the other slot 215 is defined by a pair of smaller first retainers 216B, a second spacer 214, and the inner portion 212B of a first spacer 212. As discussed further below, a space is provided between upper and lower first retainers 216B and a carrier lock 232 is mounted in that space.

The accessory carrier 200 is mounted to the track 114 by placing the carrier guide 116 into the channel 205 with left and right edges of the mounting carrier guide located in the left and right slots 215. As such, the first retainers 216A, 216B are sized to fit within the offset O between the carrier guide 116 and the vertical rack member 108. The first retainers 216A, 216B slide along one side of the carrier guide 116 and prevent the accessory carrier 200 from being removed from the carrier guide 116 of the track 114. Likewise, the inner portion 212B of the first spacers 212 slides along the opposite side of the carrier guide 116 and guide carrier guide along the track 114. The channel 205 has a first portion with a width D1 that is formed between inner surfaces of the two second spacers 214. The carrier guide 116 is sized to fit within the space between the two second spacers 214. Therefore, the carrier guide 116 has a width less than D1. Also, the combined thickness of the outer portion 212A of the first spacers 212 and the second spacers 214 is greater than the thickness of the carrier guide 116. As a result, the accessory carrier 200 slides along the track 114 with the carrier guide 116 positioned within the space between the second spacers 214. The channel 205 further includes a second portion with a width D2 that is formed between inner surface of the first retainers 216A, 216B. As mentioned earlier, a primary purpose of the first retainers 216A, 216B is to prevent the accessory carrier 200 from being removed from the carrier guide 116 of the track 114. Accordingly, the carrier guide 116 has a width greater than D2, such that, if pulled away from the track 114, the carrier guide contacts the first retainers 216A, 216B and the accessory carrier 200 maintains its connection with the track.

As mentioned earlier, the retention bar 117 connects the vertical rack member 108 to the carrier guide 116. As such, the first retainers 216A, 216B of the accessory carrier 200 are spaced apart such that the retention bar 117 of the track 114 can extend through that space and mount to the carrier guide 116. Therefore, the retention bar 117 has a width less than D2. When raised or lowered, the accessory carrier 200 slides along the track 114 with the retention bar 117 positioned within the space between the first retainers 216.

Figure 12:
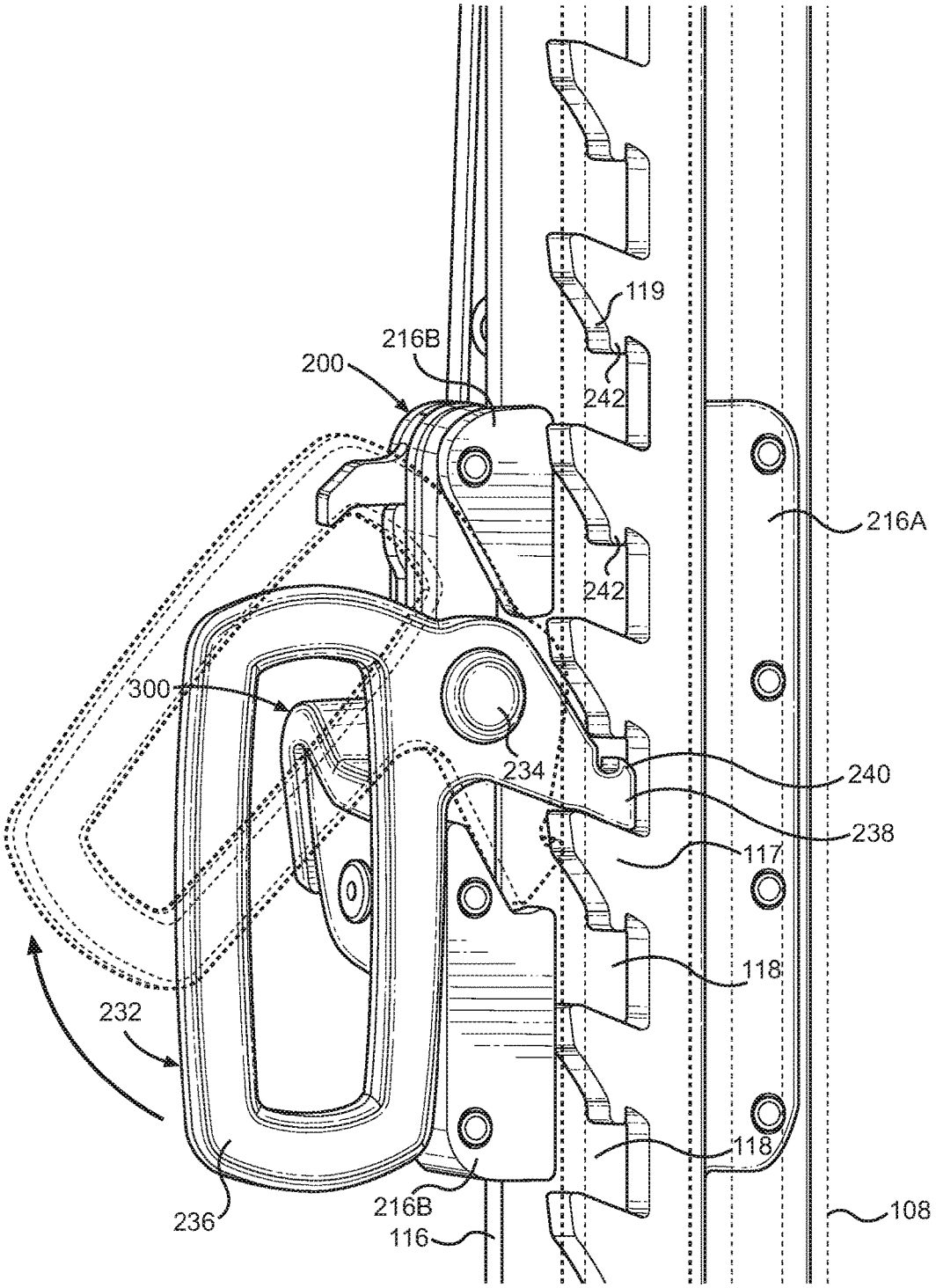
FIG. 12 depicts the accessory carrier shown in FIG. 4 mounted to an exercise rack in a first (i.e., locked) position and in a second (i.e., unlocked) position.
Figure 13A:
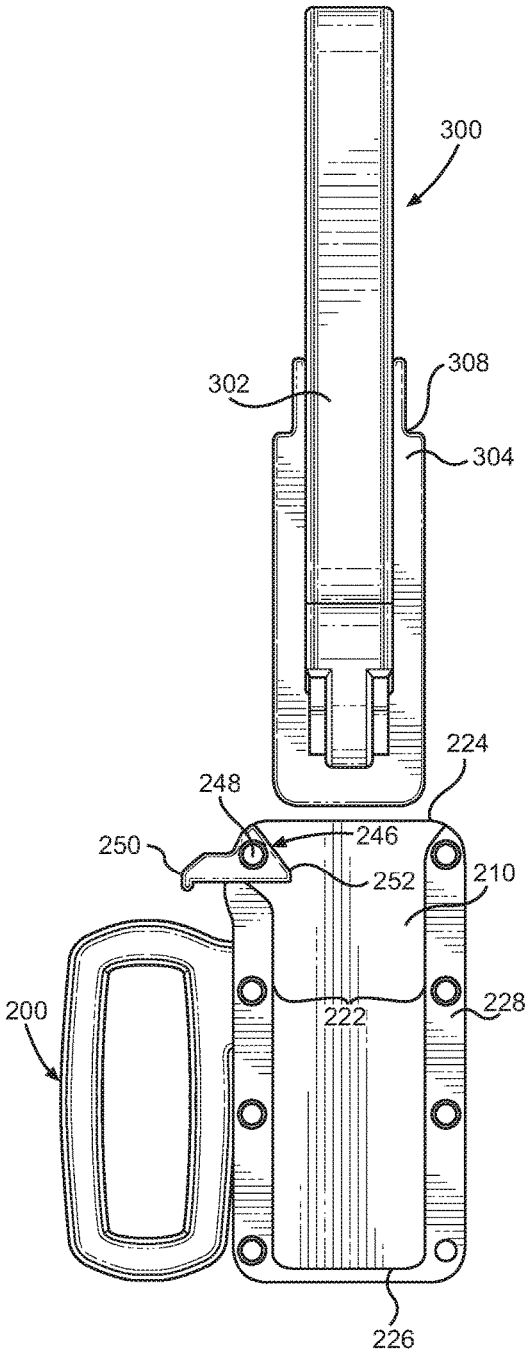
FIGS. 13A-13D depict a sequence for inserting an exercise rack accessory into an accessory carrier according to an embodiment of the present disclosure.
Figure 13B:
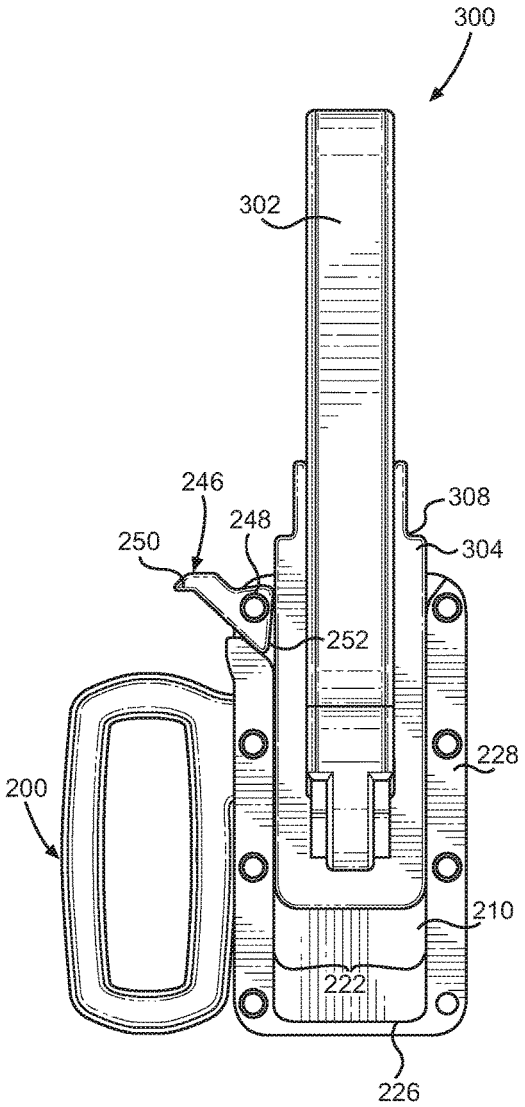
Figure 13C:
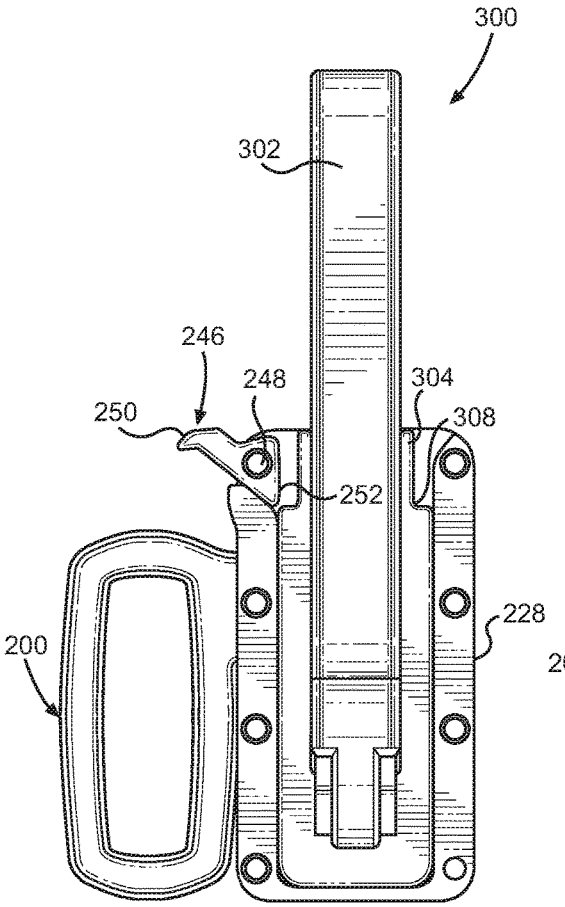
Figure 13D:
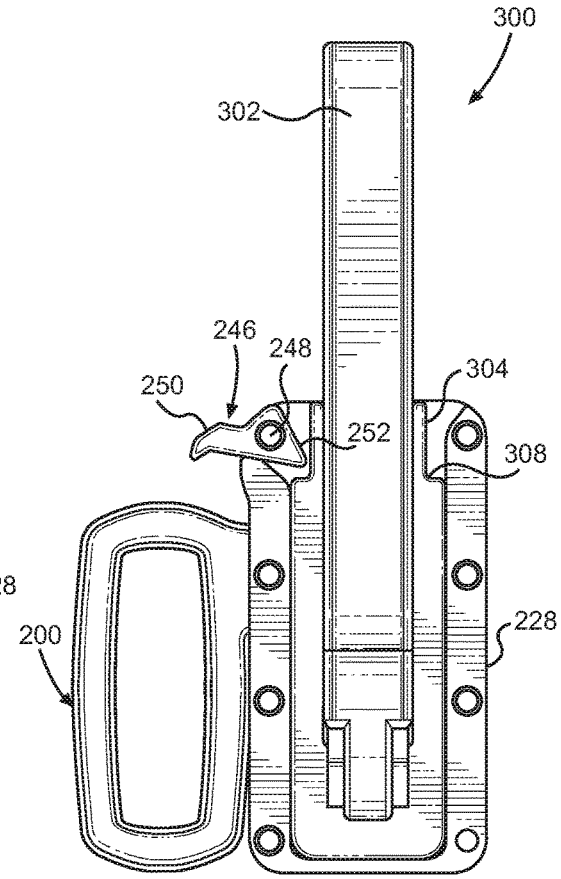

With reference to FIG. 12, when the accessory carrier 200 is positioned at the desired vertical location, the carrier lock 232 is rotated from a second (i.e., unlocked) positioned to a first (i.e., locked) position in order to securely hold the accessory carrier at that vertical position. The carrier lock 232 is pivotally mounted to the accessory carrier at a pivot point 234 located between the upper and lower first retainers 216B. The carrier lock 232 has a handle 236 on one side of the pivot point 234 for rotating the carrier lock about the pivot point and a locking tip 238 on an opposite side of the pivot point for selectively engaging with a notch 118 of the retention bar 117. The carrier lock configured to rotate between a first (i.e., locked) position, where the locking tip 238 is located within a notch 118 of the retention bar 117, and a second (i.e., unlocked) position, where the locking tip is not located within a notch. In the first (i.e., locked) position, the locking tip 238 is configured to contact a portion of a retention bar 117 to prevent the accessory carrier 200 from sliding vertically along the carrier guide 116. In the second (i.e., unlocked) position, the locking tip 238 is removed from within the notches 118 and the accessory carrier 200 can freely slide along the carrier guide 116.

The upper and lower first retainers 216B act as rotation limiting members to limit the degree of rotation that the carrier lock 232 can undergo. When the carrier lock 232 is in first (i.e., locked) position, its rotation is limited by contacting an outer face of the lower first retainer 216B. In the second (i.e., unlocked) position, the carrier lock 232 is prevented from rotating too far by contacting the upper first retainer 216B. The carrier lock 232 may be configured to also an inner face of the lower first retainer 216B.

As a safety feature, the carrier lock 232 may be biased to automatically rotate to the first (i.e., locked) position. In this particular embodiment, the handle 236 is heavier than the locking tip 238, which causes the carrier lock 232 to rotate about the pivot point 234 to the first (i.e., locked) position. In other embodiments, a spring or other similar biasing means may be provided to cause the carrier lock to be automatically rotated to the first (i.e., locked) position. To further assist the carrier lock 232 to be correctly positioned in the first (i.e., locked) position, the retention bar 217 may have contoured front sections 119 located above each of the notches 118 that slope inwards towards the notch 118. As the accessory carrier 200 is lowered, the locking tip 238 is automatically rotated so that it comes into contact and follows along the contoured section 119 and is correctly located within a notch 118. These are safety features that assist in correcting locking the accessory carrier 200 in place and, more importantly, arresting unintentional downwards movement (i.e., drops) of the accessory carrier. Preferably, when the auto-biasing carrier lock 232 is used, sustained downwards movement of the accessory carrier 200 is only possible when the carrier lock is intentionally held by a user in the second (i.e., unlocked) position by a user.

As another safety feature, the carrier lock 232 may be further provided with an upwardly extending tooth 240 that engages with a corresponding downwardly-extending tooth 242 located along a top surface of each of the notches 118 at the lower end of the contoured section 119 when the accessory carrier 200 is raised. When the teeth 240, 242 are engaged with one another, the carrier lock 232 is prevented from rotating from the first (i.e., locked) position to the second (i.e., unlocked) position. To unlock the carrier lock 232, a user is required to lift the accessory carrier 200 and then rotate the carrier lock 232 to the second (i.e., unlocked) position using then handle 236. The purpose of this safety feature is to prevent the carrier lock 232 from accidentally rotating to the second (i.e., unlocked) position and the accessory carrier falling downwards as a result (e.g., if the accessory carrier is bumped or gets caught on the user).

With reference to FIGS. 10 and 11 and FIGS. 13A-13D, the second side 204 includes a U-shaped third spacer 228 that is mounted to the central plate 210. A U-shaped second retainer 230 is then mounted to the third spacer 228. The U-shaped third spacer 228 and the U-shaped second retainer 230 are oriented so that their open ends are located at the top end of the accessory carrier 200. The second retainer 230 is wider than the third spacer 228 and a portion of the second retainer extends further into the slot 222 to form a lip 244 around the bottom and sides of the slot 222. The lip 244 of the slot 222 is configured to engage the lip 306 of the mounting plate 304. To mount an accessory 300 to the accessory carrier 200, the mounting plate 304 slides downwards through the open end of the U-shaped third spacer 228. The bottom of the mounting plate 304 is vertically supported by the inner surface of the third spacer 228 and the lip 306 of the mounting plate 304 is retained by the lip 244 formed by the second retainer 230. Once the accessory 300 is inserted into the accessory carrier 200, the use portion 302 of the accessory extends outwards through the U-shaped second retainer 230 and is available for use. To remove the accessory 300, it is simply lifted upwards out of engagement with the U-shaped third spacer 228 and U-shaped second retainer 230.

As a safety feature, the accessory carrier 200 may include a safety stop 246 for preventing the accessory 300 from accidentally disengaging from the accessory carrier. The safety stop 246 is rotatably mounted to the accessory carrier 200 via pivot point 248 and includes a user contact portion 250 disposed on one side of the pivot point and a locking tip 252 disposed on an opposite side of the pivot point. The safety stop 246 is configured to move between a second (i.e., unlocked) position, where the accessory 300 is permitted to freely slide into and out of the slot 222, and a first (i.e., locked) position, where the accessory is prevented from disengaging from the slot. Preferably, when the accessory 300 contacts the locking tip 252 of the safety stop 246, the safety stop is moved automatically to the second (i.e., unlocked) position. As a result, the accessory 300 is able to freely slide into the slot 222 because the mounting plate 304 automatically moves the safety stop 246 to the second (i.e., unlocked) position as it slides by.

Additionally, the safety stop 246 is preferably biased to the first (i.e., locked) position so that it automatically returns to the first (i.e., locked) position after the mounting plate 304 has been inserted into the slot 222 sufficiently far in order to secure the mounting plate within the slot. In this particular embodiment, the user contact portion 250 is heavier than the locking tip 252, which causes the safety stop 246 to rotate about the pivot 248 to the first (i.e., locked) position. In other embodiments, a spring or other similar biasing means may be provided to cause the safety stop 246 to be automatically rotated to the first (i.e., locked) position.

In the first (i.e., locked) position, the locking tip 252 may simply top surface of the mounting plate 304 of the accessory 300. However, in other embodiments, the mounting plate 304 may be provided with one or more notches 308 formed in a top surface of the lip portion 306, and the locking tip 252 of the safety stop engages the notch in the first (i.e., locked) position. In preferred embodiments, the mounting plate 304 is provided with notches 308 located on both the left and right sides of the top surface of the mounting plate 304. This allows the same accessory 300 to be used interchangeably in accessory carriers 200 with either left or right-located safety stops 246.

The foregoing description of preferred embodiments for this disclosure have been presented for purposes of illustration and description. They are not intended to be exhaustive or to limit the disclosure to the precise form disclosed. Obvious modifications or variations are possible in light of the above teachings. The embodiments are chosen and described in an effort to provide the best illustrations of the principles of the disclosure and its practical application, and to thereby enable one of ordinary skill in the art to utilize the invention in various embodiments and with various modifications as are suited to the particular use contemplated. All such modifications and variations are within the scope of the disclosure as determined by the appended claims when interpreted in accordance with the breadth to which they are fairly, legally, and equitably entitled.

What is claimed is:

1. A quick disconnect exercise rack accessory apparatus comprising:

an accessory for an exercise rack having a use portion and a mounting plate fixedly mounted to an end of the use portion;

an accessory carrier having a first side configured to mount to the exercise rack and a second side configured to connect to the accessory;

a slot formed in the second side of the accessory carrier having an open end, an inner section and an outer section in communication with the inner section;

wherein the accessory is removably mounted to the accessory carrier by sliding the mounting plate into the slot via the open end such that the mounting plate is located within the inner section of the slot and the accessory extends through the outer section of the slot; a safety stop disposed on the accessory carrier proximate the slot and being configured to move between a second position and a first position, wherein the safety stop is in the second position and the mounting plate is located within the slot, the mounting plate is configured to slide out of the slot freely, and wherein, when the safety stop is in the first position and the mounting plate is located within the slot, the safety stop engages the mounting plate and prevents the mounting plate from sliding out of the slot.

2. The apparatus of claim 1 wherein the safety stop is rotatably mounted to the accessory carrier via a pivot point and has a user contact portion disposed on one side of the pivot point configured to be contacted by a user to rotate the safety stop about the pivot point to move the safety stop from the first position to the second position; and a locking tip disposed on an opposite side of the pivot point configured to engage a portion of the mounting plate in the first position.

3. The apparatus of claim 2 further comprising a notch formed proximate a top surface of the mounting plate, wherein the locking tip of the safety stop engages the notch in the first position.

4. The apparatus of claim 3 wherein the notch comprises a left notch located on a left side of the top surface of the mounting plate and a right notch located on a right side of the top surface of the mounting plate, such that the safety stop is configured to engage either the left side or right side of the mounting plate.

5. The apparatus of claim 1 further comprising a biasing member for biasing the safety stop to the first position.

6. The apparatus of claim 5 wherein the safety stop is configured to be contacted by and moved automatically to the second position by the mounting plate as the mounting plate slides into the slot and the biasing member automatically returns the safety stop to the first position after the mounting plate has been inserted into the slot sufficiently far in order to secure the mounting plate within the slot.

7. The apparatus of claim 1 further comprising:

a vertical rack member;

a track disposed on the vertical rack member having: an elongate carrier guide extending along a length of the track; and a retention bar having plurality of notches formed therein and connecting the elongate carrier guide to the vertical rack member, wherein the accessory carrier is configured to engage and to slide vertically along the elongate carrier guide; and a carrier lock pivotally mounted to the accessory carrier at a pivot point and having a handle located on one side of the pivot point for rotating the carrier lock about the pivot point and a locking tip on an opposite side of the pivot point for selectively engaging a notch of the plurality of notches of the retention bar for securing the accessory carrier at a selected vertical position on the track, the carrier lock configured to rotate between a first position where the locking tip is located within a notch of the plurality of notches and contacts a portion of the retention bar to prevent the accessory carrier from sliding vertically along the elongate carrier guide and a second position where the locking tip is not located within a notch of the plurality of notches and the accessory carrier is configured to freely slide along the elongate carrier guide.

8. The apparatus of claim 7 further comprising:

an upwardly-extending tooth located on the locking tip of the carrier lock; and a downwardly-extending tooth located within each of the notches of the plurality of notches, wherein the upwardly-extending tooth engages with a respective downwardly-extending tooth of the plurality of notches when the carrier lock is in the first position and the accessory carrier is raised vertically, such that the carrier lock is prevented from rotating to the second position due to the engagement between the upwardly-extending tooth and the respective downwardly-extending tooth.

9. The apparatus of claim 7 further comprising first and second rotation limiting members disposed below and above the carrier lock for limiting the rotation of the carrier lock, when the carrier lock is in first position its rotation is limited by the first rotation limiting member and when the carrier lock is in second position its rotation is limited by the second rotation limiting member.

10. The apparatus of claim 7 wherein each notch of the plurality of notches has contoured section that is sloped away from the carrier lock, where a bottom end of the contoured section is furthest from the carrier lock and a top end of the contoured section is nearest the carrier lock, the contoured section configured to contact a portion of the carrier lock and to guide it into the first position.

11. The apparatus of claim 1 wherein the mounting plate further comprises a lip portion that extends outwards beyond an exterior surface of the use portion and the slot of the accessory carrier further comprises a lip portion disposed along an inner surface of the outer section that is configured to engage the lip portion of the mounting plate to prevent the mounting plate from being removed via the outer section of the slot such that the accessory is configured to be removed by sliding the accessory and the mounting plate out of the carrier via the open end in the slot.

12. The apparatus of claim 1 wherein the accessory carrier comprises a first accessory carrier and a second accessory carrier and wherein the mounting plate comprises a first mounting plate located at a first end of the accessory and a second mounting plate located at a second end of the accessory, wherein either of the first and second mounting plates is configured to be removably mounted to either of the first and second accessory carriers.

13. A quick disconnect exercise rack accessory apparatus comprising:

an accessory for an exercise rack having a use portion and a mounting plate fixedly mounted to an end of the use portion;

an accessory carrier having a first side configured to mount to the exercise rack and a second side configured to connect to the accessory;

a pocket formed in the accessory carrier having an open end; and a slot extending through the second side of the accessory carrier to the pocket, wherein the accessory is removably mounted to the accessory carrier by sliding the mounting plate into the pocket via the open end such that the mounting plate is located within the pocket and a portion of the accessory extends out of the pocket via the slot such that the use portion is located outside of the pocket; a safety stop disposed on the accessory carrier proximate the slot and being configured to move between a second position and a first position, wherein the safety stop is in the second position and the mounting plate is located within the slot, the mounting plate is configured to slide out of the slot freely, and wherein, when the safety stop is in the first position and the mounting plate is located within the slot, the safety stop engages the mounting plate and prevents the mounting plate from sliding out of the slot.

* * * * *